US008005412B2

(12) United States Patent
Sakashita et al.

(10) Patent No.: US 8,005,412 B2
(45) Date of Patent: Aug. 23, 2011

(54) TRANSFER DEVICE AND IMAGE FORMING APPARATUS

(75) Inventors: Takeshi Sakashita, Osaka (JP); Yuuji Meguro, Hyogo (JP); Takeru Muramatsu, Osaka (JP); Mitsutoshi Kichise, Osaka (JP); Takuya Etoh, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 439 days.

(21) Appl. No.: 12/266,769

(22) Filed: Nov. 7, 2008

(65) Prior Publication Data

US 2009/0129831 A1 May 21, 2009

(30) Foreign Application Priority Data

Nov. 21, 2007 (JP) ..... 2007-301419

(51) Int. Cl.
*G03G 15/16* (2006.01)

(52) U.S. Cl. ..... 399/316; 399/66; 399/315; 399/400

(58) Field of Classification Search ..... 399/316, 399/315, 66, 388, 400
See application file for complete search history.

(56) References Cited

U.S. PATENT DOCUMENTS

| | | | | |
|---|---|---|---|---|
| 4,491,407 | A * | 1/1985 | Mitsuyama et al. | 399/316 |
| 5,159,392 | A * | 10/1992 | Kasahara et al. | 399/309 |
| 5,812,920 | A * | 9/1998 | Mizude et al. | 399/316 |
| 2008/0310893 | A1 * | 12/2008 | Adachi et al. | 399/316 X |

FOREIGN PATENT DOCUMENTS

| | | | |
|---|---|---|---|
| JP | 58-136070 | A * | 8/1983 |
| JP | 5-107944 | | 4/1993 |
| JP | 05-107955 | A * | 4/1993 |
| JP | 9-40225 | | 2/1997 |
| JP | 11-7200 | | 1/1999 |
| JP | 2004-212634 | A * | 7/2004 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

A neutralizing mechanism is provided on at least one conveying path proximal member installed on a conveying path of a sheet material in a vicinity of a transfer position, and is grounded by using a conducting material. The neutralizing mechanism includes a neutralizing circuit that includes a resistor and a ground switch electrically connected in parallel to each other. The ground switch is turned off at least at a time of applying the transfer bias to prevent a leakage of a transfer current, and turned on for a predetermined time at a time other than the time of applying the transfer bias to earth and remove a static electricity from the conveying path proximal member.

14 Claims, 3 Drawing Sheets

TRANSFER DEVICE AND IMAGE FORMING APPARATUS

CROSS-REFERENCE TO RELATED APPLICATIONS

The present application claims priority to and incorporates by reference the entire contents of Japanese priority document 2007-301419 filed in Japan on Nov. 21, 2007.

BACKGROUND OF THE INVENTION

1. Field of the Invention

The present invention relates to an electrophotographic image forming apparatus such as a copier, a facsimile, a printer, and a multifunction peripheral (MFP) and a transfer device that uses an electrostatic image transfer process, and more particularly, relates to a technology for enhancing a neutralizing mechanism for members arranged in the vicinity of the transfer device used in the image forming apparatus.

2. Description of the Related Art

Generally, in an image forming apparatus, a toner image is formed on an outer peripheral surface of image carrying members such as a photosensitive drum, a photosensitive belt, and an intermediate transfer belt by using an exposure device and a developing device based on an electrophotographic method. Furthermore, an electric field having a reverse polarity with respect to a charging polarity of the toner image is formed in the image forming apparatus by applying a transfer bias (transfer voltage). The image forming apparatus includes a transfer device that generates an electrostatic attractive force by forming the electric fields as described above and that transfers the image from the image carrying members onto sheet materials such as copy sheets, thick sheets, and resin sheets including OHP transparencies (an electrostatic repulsive force can also be used by using an electric field having the same polarity with the toner image).

Thus, the transfer device, which uses the electrostatic image transfer process, uses a transfer method that is broadly classified into a direct transfer method and an indirect transfer method. In the direct transfer method, the toner image is formed on multi-color or mono-color latent image carrying members such as the photosensitive drum and the photosensitive belt by using a developing unit and the toner image is directly transferred onto the sheet material from the latent image carrying members that are the image carrying members for carrying the toner image. In the indirect transfer method, the toner image is once transferred onto an intermediate transfer body such as the intermediate transfer belt from the multi-color latent image carrying member by a primary transfer unit and subsequently, the toner image is collectively transferred onto the sheet material by a secondary transfer unit.

The transfer device also uses a contact method and a non-contact method. In the contact method, the transfer bias is applied by causing transfer bias applying units such as transfer rollers (a transfer roller of the direct transfer method and a primary transfer roller and a secondary transfer roller of the indirect transfer method) to directly contact transfer electric field forming target objects (belt members such as a conveying belt of the direct transfer method and the intermediate transfer belt of the indirect transfer method, and the sheet materials). In the non-contact method, the transfer bias is applied without causing the transfer bias applying unit such as a corona discharger to contact the transfer electric field forming target object.

However, the transfer device using the direct transfer method and the transfer device using the indirect transfer method commonly use the electrostatic image transfer process, in other words, form the transfer electric field by applying the transfer bias by using the transfer bias applying unit. Thus, the transfer device needs to be formed such that members, which contact at the time of applying the transfer bias, the transfer electric field forming target objects such as the intermediate transfer belt and the sheet material or which are within the range of fixed distance from the transfer electric field forming target objects such as the intermediate transfer belt and the sheet material, include an electric resistance (volume resistance) that is greater than or equal to a fixed value such that the transfer bias is not leaked.

Thus, if the transfer device includes the members including the resistance greater than or equal to a fixed value, naturally generated static electricity is less likely to flow and escape to another members. Due to this, the sheet material is repeatedly conveyed and due to friction (including contact, separation, and collision, hereinafter the same) with the sheet material or air, the member is positively or negatively charged. The generated static electricity is accumulated on the members, thus resulting in occurrence of bias in electric potential. If the static electricity is accumulated on the members that are within the fixed range (generally, a shortest distance is within five millimeters (mm)) from the sheet material, thus resulting in high potential static electricity, the sheet material is partially charged due to contact or electric discharge between the members and the sheet material before transferring the toner image onto the sheet material. Furthermore, when the sheet material carrying the toner image passes through the vicinity of the members after the toner image is transferred onto the sheet material, an unfixed toner image spoils due to the high potential static electricity accumulated on the members, thus deteriorating image quality such as toner scattering and raggedness of the image.

In other words, because the members are within the fixed range from the transfer electric field forming target object, the members need to be formed by including an electric resistance that is greater than or equal to a predetermined value to ensure that transfer current (or voltage) is not leaked. The members (hereinafter, called conveying path proximal members), which are arranged opposite a conveying path of the sheet material and are likely to charge due to friction with the sheet material or air, need to be neutralized by arranging a neutralizing mechanism. In the neutralizing mechanism, the members are ground connected by using a conducting material and earthed. However, for neutralizing the conveying path proximal member, a minimum resistance from the conveying path proximal member until ground connection of the conveying path proximal member is reduced such that the charged static electricity can flow easily. However, the conveying path proximal member is formed of a material of a high resistance to ensure that the transfer bias is not leaked. In other words, the conveying path proximal member necessitates the high (electric) resistance from the viewpoint that the transfer bias is not leaked and also necessitates a low resistance from the viewpoint that failure occurring due to charging can be prevented. In other words, it is necessary to simultaneously overcome two drawbacks that are inversely related to each other.

Whether the conveying path proximal member is to be charged positively or negatively is determined by a sequence of triboelectric series between a material of the sheet material and a material of the conveying path proximal member, in other words, based on a relative ease of emitting electrons. For example, when the sheet material is formed of a paper and the conveying path proximal member is formed of polyethylene resin, as compared to polyethylene resin, the triboelectric series for the paper is on a plus side, thus negatively charging the conveying path proximal member.

As an example of the existing image forming apparatus that includes the neutralizing mechanism, an image forming apparatus that is disclosed in Japanese Patent Application Laid-open No. H9-40225 is explained. The image forming apparatus transfers a toner image on an image carrying member onto a transfer material by using a transfer roller. In the image forming apparatus in which the toner image is separated from the transfer material that is neutralized by a neutralizing needle unit, if a separation detecting sensor detects that the transfer material is incorrectly separated from the image carrying member, a controller changes over a switch, thus changing over bias voltage from high-voltage power supplies to neutralizing needles. Based on environmental conditions, quality of a transfer material, usage conditions of neutralizing needles, optimal neutralizing conditions are set and to deal with changes in charge-retaining force due to dampness of the transfer material, changes in charge-retaining force due to change in the resistance according to the material of the image carrying member, adhesion of toner on points of the neutralizing needles, and degradation of neutralizing properties due to electric discharge, the transfer material is separated from the image carrying member that is neutralized by optimal conditions.

However, in this image forming apparatus, for separating the transfer material, which is the sheet material, from a belt, the transfer material is neutralized by the neutralizing needles. By effectively changing over the high-voltage power supplies, potential of the transfer material can be controlled. However, occurrence of image degradation by charging the conveying path proximal member is not taken into consideration in the image forming apparatus.

As another example of the existing image forming apparatus, an image forming apparatus that is disclosed in Japanese Patent Application Laid-open No. H11-7200 is explained. The image forming apparatus includes a primary charger (charging unit), an image exposing unit (image data writing unit), a developer (developing unit), a transfer roller (transferring unit) that transfers the toner image formed by the developer onto a transfer material, neutralizing needles (separating unit) that facilitate separation of the transfer material after transfer from a photosensitive drum. In the image forming apparatus, a contact transfer method is adopted in the transfer roller and a transfer bias power supply (transfer bias supplying unit) that supplies the transfer bias to the transfer roller and a separation bias power supply (separation bias supplying unit) that supplies the separation bias to the neutralizing needles are arranged. The neutralizing needles are ground connected via a variable resistance body or a conducting switch and according to a transfer bias supply starting time of the transfer bias power supply (transfer bias supplying unit), the resistance of the variable resistance body is set smaller than the resistance after the transfer bias supply starting time or according to the transfer bias supply starting time, a conducting switch is conducted and conduction is released at a predetermined time.

However, in this image forming apparatus, by arranging the variable resistance body, a plurality of resistors and controlling units thereof are required for changing over the resistance of the variable resistance body. Therefore, a structure of the image forming apparatus becomes complex, thus increasing a cost. Furthermore, the entire image forming apparatus cannot be made compact.

SUMMARY OF THE INVENTION

It is an object of the present invention to at least partially solve the problems in the conventional technology.

According to one aspect of the present invention, there is provided a transfer device that transfers an image from an image carrying member onto a sheet material by applying a transfer bias. The transfer device includes a neutralizing mechanism that is provided in at least one conveying path proximal member from among a plurality of conveying path proximal members that is installed on conveying paths of the sheet material in a vicinity of a transfer position, makes contact with the sheet material at a time of applying the transfer bias or is placed within a range of a fixed distance from the sheet material, and is grounded by using a conducting material. The neutralizing mechanism includes a neutralizing circuit that includes a first resistor having a first resistance and a ground switch electrically connected in parallel to each other. The ground switch is turned off at least at a time of applying the transfer bias to prevent a leakage of a transfer current, and turned on for a predetermined time at a time other than the time of applying the transfer bias to earth and remove a static electricity accumulated on the conveying path proximal member.

Furthermore, according to another aspect of the present invention, there is provided an image forming apparatus including a transfer device that transfers an image from an image carrying member onto a sheet material by applying a transfer bias, the transfer device including a neutralizing mechanism that is provided in at least one conveying path proximal member from among a plurality of conveying path proximal members that is installed on conveying paths of the sheet material in a vicinity of a transfer position, makes contact with the sheet material or is placed within a range of a fixed distance from the sheet material, and is grounded by using a conducting material. The neutralizing mechanism includes a neutralizing circuit that includes a first resistor having a first resistance and a ground switch electrically connected in parallel to each other. The ground switch is turned off at least at a time of applying the transfer bias to prevent a leakage of a transfer current, and turned on for a predetermined time at a time other than the time of applying the transfer bias to earth and remove a static electricity accumulated on the conveying path proximal member.

Moreover, according to still another aspect of the present invention, there is provided an image forming apparatus including a transfer device that directly transfers an image from an intermediate transfer belt onto a sheet material; and a neutralizing mechanism that is provided in at least one conveying path proximal member from among a plurality of conveying path proximal members that is installed on conveying paths of the sheet material in a vicinity of a secondary transfer position, makes contact with the sheet material at a time of applying the secondary transfer bias or is placed within a range of a fixed distance from the sheet material, and is grounded by using a conducting material. The neutralizing mechanism includes a neutralizing circuit that includes a first resistor having a first resistance and a ground switch electrically connected in parallel to each other. The ground switch is turned off at least at a time of applying the secondary transfer bias to prevent a leakage of a transfer current, and turned on for a predetermined time at a time other than the time of applying the secondary transfer bias to earth and remove a static electricity accumulated on the conveying path proximal member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained in detail below with reference to the accompanying drawings.

Figure 1:
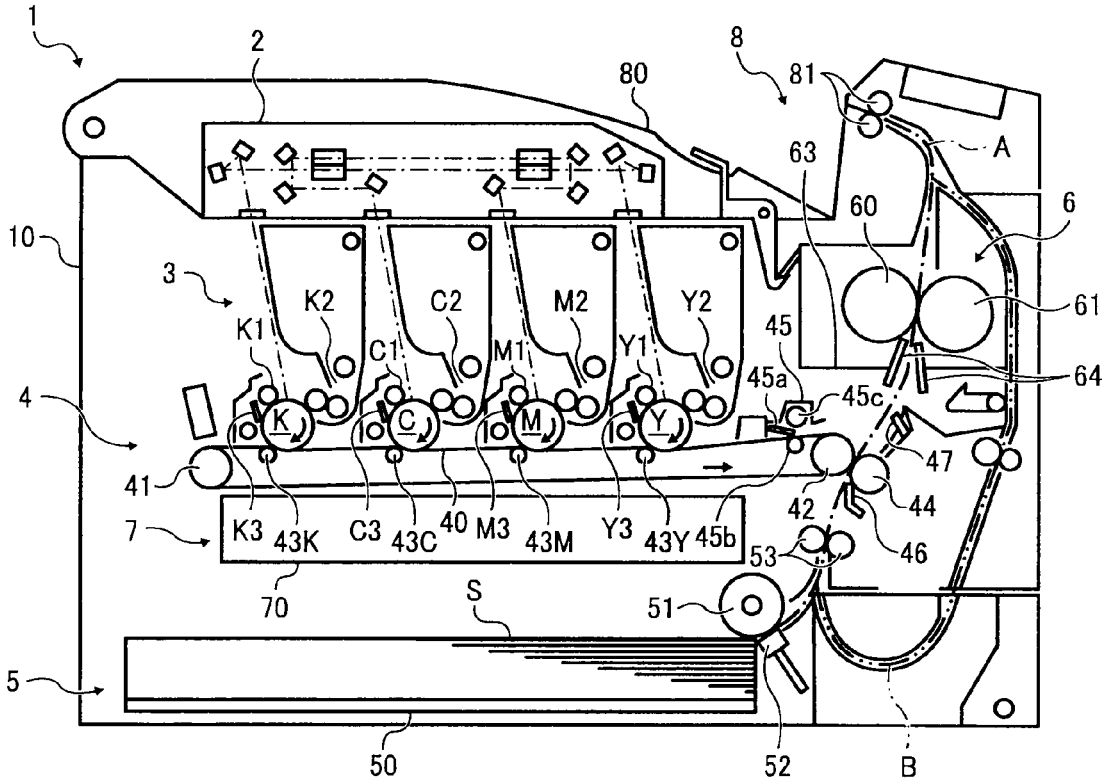
FIG. 1 is a schematic diagram for explaining an overview of an entire image forming apparatus according to an embodiment of the present invention.

FIG. 1 is a schematic diagram for explaining an overview of a four-color tandem-type printer 1 as an image forming apparatus according to an embodiment of the present invention. The printer 1 mainly includes a nearly chassis-like device body 10, a laser scanning unit (LSU) 2 that is arranged nearly at the top inside the device body 10, an image forming unit 3 that is below the LSU 2 and that is arranged nearly in the middle inside the device body 10, a transfer unit 4 that is arranged below the image forming unit 3, a sheet feeding unit 5 that is further below the transfer unit 4 and is arranged nearly at the bottom inside the device body 10, a fixing unit 6 that is next to the image forming unit 3 and is close to one side surface inside the device body 10, a waste-toner storage unit 7 that is arranged between the transfer unit 4 and the sheet feeding unit 5, and a sheet loading unit 8 that is formed in the vicinity of an outer top surface of the device body 10.

The LSU 2 carries out scanning while irradiating a laser beam based on an image data input from a personal computer. The LSU 2 functions as an exposure unit that exposes uniformly charged outer peripheral surfaces of photosensitive drums that are explained later and forms an electrostatic latent image on the photosensitive drums.

In the image forming unit 3, four photosensitive drums such as yellow (Y), magenta (M), cyan (C), black (K), which are image carrying members, corresponding to Y, M, C, K toners are arranged. Around the respective photosensitive drum Y, M, C, K, charging units Y1, M1, C1, K1, developing units Y2, M2, C2, K2, and cleaners Y3, M3, C3, K3 are respectively arranged. The charging units Y1, M1, C1, K1 execute a charging process on the outer peripheral surfaces of the photosensitive drums Y, M, C, K and uniformly charges the outer peripheral surfaces. The developing units Y2, M2, C2, K2 convert the electrostatic latent image formed on the photosensitive drums Y, M, C, K by the LSU 2 to a visual monochromatic toner image by using each toner color. The cleaners Y3, M3, C3, K3 cause a cleaning blade to come into contact with the outer peripheral surfaces of the photosensitive drums Y, M, C, K after transfer, scrap, and clean the residual toner.

The transfer unit 4 includes an endless intermediate transfer belt 40, two supporting rollers 41 and 42, four primary transfer rollers 43Y, 43M, 43C, 43K, a secondary transfer roller 44, and a cleaning unit 45 of the intermediate transfer belt 40. The intermediate transfer belt 40 is an image carrying member or an intermediate transfer body and the supporting rollers 41 and 42 support and stretch the intermediate transfer belt 40. The primary transfer rollers 43Y, 43M, 43C, 43K are arranged opposite the photosensitive drums Y, M, C, k such that the intermediate transfer belt 40 is sandwiched between the primary transfer rollers 43Y, 43M, 43C, 43K and the photosensitive drums Y, M, C, K. The secondary transfer roller 44 is arranged opposite the supporting roller 42 that is also a driving roller such that the intermediate transfer belt 40 is sandwiched between the secondary transfer roller 44 and the supporting roller 42.

The primary transfer rollers 43Y, 43M, 43C, 43K, which are transfer bias applying units of a contact method, are arranged, by considering image degradation due to void discharge, at a position that is slightly displaced towards a downstream side in a conveying direction (an arrow direction shown in FIG. 1) of the intermediate transfer belt 40 from a correct position that comes into contact with the respective photosensitive drum Y, M, C, K across the intermediate transfer belt 40. The primary transfer rollers 43Y, 43M, 43C, 43K are connected to a (not shown) bias power supply. A primary transfer bias is applied from a rear face (inner peripheral surface) of the intermediate transfer belt 40.

The secondary transfer roller 44 pressure contacts the intermediate transfer belt 40 on an outer periphery of the driving roller 42 by a (not shown) biasing unit such that a secondary transfer nip is formed. The driving roller 42 is the transfer bias applying unit of the contact method that is connected to the (not shown) bias power supply. Furthermore, the secondary transfer roller 44 can be used as the transfer bias applying unit. When the secondary transfer roller 44 is used as the transfer bias applying unit, the transfer bias of a reverse polarity with respect to a polarity of the transferred toner image is applied.

The cleaning unit 45, which uses a blade method, is formed of a cleaning blade 45*a*, a backup roller 45*b*, and a conveying screw 45*c*. The intermediate transfer belt 40 is pressed from inside by the backup roller 45*b* and on the peripheral surface of the backup roller 45*b*, the cleaning blade 45*a* comes into contact with the intermediate transfer belt 40 and scrapes the residual toner that is left on a surface of the intermediate transfer belt 40 even after secondary transfer.

Furthermore, a pre-secondary transfer guide 46 and neutralizing needles 47 are also arranged in the transfer unit 4. The pre-secondary transfer guide 46 guides a sheet material S to the secondary transfer nip, and the neutralizing needles 47, which are self-discharge-type neutralizing members using a corona discharge, neutralize the sheet material S after transfer.

The pre-secondary transfer guide 46, which is a nearly rectangular plate, is positioned such that an axial direction of the secondary transfer roller 44 becomes a longitudinal direction and with respect to a conveying path A of the sheet material S that is explained later, a plate surface is positioned by inclining at a predetermined angle such that the sheet material S is guided to the secondary transfer nip. Upon conveying the sheet material S, even if a tip of the sheet material S touches the pre-secondary transfer guide 46, the sheet material S can be smoothly guided to the secondary transfer nip because the pre-secondary transfer guide 46 is inclined at the predetermined angle with respect to the conveying path A.

The neutralizing needles 47 are arranged such that a plurality of needles are parallely arranged along the axial direction of the secondary transfer roller 44. The neutralizing needles 47 are arranged opposite the conveying path A and are fixed such that needle points protrude towards the conveying path A. The neutralizing needles 47 are connected to a (not shown) power supply. Upon the sheet material S after secondary transfer passing through the proximity of the needle points, the neutralizing needles 47 remove the charge that is retained on the sheet material S after the sheet material S passes through the secondary transfer nip due to air ionized by the corona discharge. Thus, in the conveying direction, image degradation due to electric discharge between peripheral members of the conveying path A from the neutralizing needles 47 onwards and the sheet material S can be prevented. Furthermore, the neutralizing needles 47 enable to prevent sticking of the sheet material S that is not properly separated from the secondary transfer roller 44 or the intermediate transfer belt 40 due to the static electricity charged on the sheet material S, and displacement of the transfer position.

The neutralizing needles 47 can be neutralizing members of a contact type that are connected by a conducting material. The neutralizing needles 47 contact the sheet material S after the sheet material S passes through the secondary transfer nip, and earth the static electricity on the sheet material S to the ground.

The sheet feeding unit 5 includes a feed tray 50 that houses and stocks sheet materials S such as copy sheets and resin sheets (overhead projector (OHP) sheets, etc.) of a predetermined size, a feed roller 51 that pressure contacts the stocked sheet material S at a predetermined pressure and one by one transmits, based on control signals of a (not shown) controller, a recording medium, a friction pad 52 as a separating member that separates to a single sheet, the bulk transmitted sheet materials S that are formed of elastomer, and a registration roller pair 53 that adjusts a timing for conveying the sheet material S to the secondary transfer nip. Instead of the friction pad 52 that is the separating unit, a reverse roller of a torque limiter method can be used.

The fixing unit 6 includes a fixing roller 60 and a pressure roller 61. The pressure roller 61 that is biased by the (not shown) biasing unit, pressure contacts the fixing roller 60, thus forming a fixing nip. In the fixing nip, by applying heat using a (not shown) heating unit that is arranged inside the fixing roller 60 and applying pressure of the pressure roller 61 using the biasing unit to the conveyed sheet material S, the carried toner image is fixed on the sheet material S. The fixing unit 6 is covered by a nearly chassis-like fixing frame 63 and is separated from another portion. Insulating the internally generated heat ensures that heat transfer to the image forming unit 3 becomes difficult. A pre-fixing guide 64 that guides the sheet material S to the fixing nip is fixed to the fixing frame 63. Due to this, the sheet material S can be smoothly guided to the fixing nip.

A waste-toner collecting box 70 is included in the waste-toner storage unit 7. Waste toner that is scrapped by the cleaners Y3, M3, C3, K3 of the respective photosensitive drum Y, M, C, K and the cleaning unit 45 of the intermediate transfer belt 40 is conveyed by a (not shown) conveying unit such as a conveying screw and is housed in the waste-toner collecting box 70.

The sheet loading unit 8 includes a discharge tray 80 that is formed at the top surface outside the device body 10 and a discharging roller pair 81 that discharges the sheet material S to the discharge tray 80 from the device body 10. The discharging roller pair 81 discharges from the conveying path A that is explained later, the sheet material S, which has passed through the fixing unit 6 and includes a fixed image, is discharged in the discharge tray 80 and is accumulated in the discharge tray 80.

As shown in FIG. 1, in the printer 1, a conveying path that reaches between the discharging roller pair 81 of the sheet loading unit 8 via the secondary transfer nip of the transfer unit 4 and the fixing nip of the fixing unit 6 from the sheet feeding unit 5 is the conveying path A that is a normal conveying path of the sheet material S. Furthermore, a conveying path that reaches the registration roller pair 53 of the sheet feeding unit 5 via the outer side of the conveying path A that is bifurcated from the upper side of the fixing unit 6 is a conveying path B that is a conveying path for backside printing and that causes the sheet material S to reverse for duplex printing. In the conveying paths A and B, a plurality of conveying roller pairs are arranged at an interval according to the minimum size of the sheet material S that is to be conveyed and by driving the conveying roller pairs, the sheet material S is conveyed.

Operations of the image forming apparatus such as the printer 1 are explained with reference to FIG. 1.

Color image forming operations are explained below. Upon starting the image forming operations in the printer 1, the photosensitive drums Y, M, C, K are rotatably driven in an arrow direction (clockwise direction if viewed from a front door of the printer 1) shown in FIG. 1. When the photosensitive drums Y, M, C, K are rotatably driven, the outer peripheral surfaces of the photosensitive drums Y, M, C, K are uniformly charged to a predetermined polarity by the charging units Y1, M1, C1 K1. Next, from the LSU 2, the laser beam is irradiated on the charged surface based on the image data separated to each predetermined color. Due to this, the electrostatic latent image is formed on the outer peripheral surface of the respective photosensitive drum Y, M, C, K. The developing units Y2, M2, C2, K2 convert the electrostatic latent image to the visual image as the monochromatic toner image. The toner image of the respective color is sequentially overlapped and transferred on the intermediate transfer belt 40 to which the primary transfer bias is applied by the respective corresponding primary transfer roller 43Y, 43M, 43C, 43K, thus forming the color toner image. For forming the monochromatic image, the operations are carried out only by using a predetermined monochromatic photosensitive drum such as the photosensitive drum K of black color.

However, the sheet materials S stocked in the feed tray 50 of the sheet feeding unit 5 are one by one separated by contact pressure and driving of the feed roller 51 and the friction pad 52 and are transmitted to the registration roller pair 53. The tip of the sheet material S touches the stopped registration roller pair 53. Thus, after the sheet material S is aligned, the intermediate transfer belt 40 is rotated by driving the driving roller 42 and the registration roller pair 53 rotates at the timing when the color toner image that is formed on the intermediate transfer belt 40 reaches the secondary transfer nip, and the sheet material S is transmitted towards the secondary transfer nip in an upward direction. For accurately inserting the sheet material S into the secondary transfer nip, the registration roller pair 53 guides the sheet material S such that the tip of the sheet material S touches the pre-secondary transfer guide 46 and by deciding a position, the sheet material S is inserted.

The sheet material S to which the toner image is transferred in the secondary transfer nip is transferred to the fixing nip. The fixing roller 60 and the pressure roller 61 apply heat and pressure and the unfixed toner image that is carried by the sheet material S is fixed onto the sheet material S. Thus, for accurately inserting the sheet material S into the fixing nip, the sheet material S is guided by touching the tip of the sheet material S to the pre-fixing guide 64 and by deciding the position, the sheet material S is inserted. Because the charge retained on the sheet material S is neutralized by the neutralizing needles 47, the sheet material S can be suitably separated from the intermediate transfer belt 40. After the toner image is fixed onto the sheet material S, the discharging roller pair 81 rotates and the sheet material S is discharged in the discharge tray 80 of the sheet loading unit 8 from the conveying path A. The residual toner adhered to the surface of the intermediate transfer belt 40 after secondary transfer is removed by the cleaning unit 45 and is used for further image forming operations. While carrying out duplex printing, upon fixing the image on one side in the fixing nip, the sheet material S is switched over to the conveying path B from the conveying path A by a (not shown) switching unit. The sheet material S is reversed while conveying in the conveying path B and once again transferred to the registration roller pair 53. The operations are repeated and the image is transferred and fixed to the other surface.

A neutralizing mechanism that is the main component of the present invention is explained with reference to FIGS. 2 to 5. In all the embodiments, the basic structure of the printer 1 that is the image forming apparatus is same as the printer 1 shown in FIG. 1. Thus, in FIGS. 2 to 5, the neutralizing mechanism is explained by using the same reference numerals.

As explained in the related art, "conveying path proximal member" necessitates a high (electric) resistance from the viewpoint that the transfer bias is not leaked and also necessitates a low resistance from the viewpoint that failure occurring due to charging can be prevented. Both the drawbacks need to be simultaneously overcome. Thus, in the present invention, the neutralizing mechanism arranged in "conveying path proximal member" is enhanced as indicated in embodiments explained below. "Conveying path proximal members", although explained earlier, are arranged opposite the conveying path of the sheet material S in the vicinity of the transfer position. Due to friction with the sheet material S or air, "conveying path proximal members" are likely to be charged positively or negatively. At the time of applying the transfer bias, the conveying path proximal members contact the sheet material S or the conveying path proximal members are within the range of fixed distance from the sheet material S. Thus, there is a likelihood of leakage of the transfer bias (transfer voltage or transfer current). To be specific, "conveying path proximal members" are the registration roller pair 53, the secondary transfer roller 44, the pre-secondary transfer guide 46, the neutralizing needles 47, the pre-fixing guide 64, the fixing frame 63, and the conveying path for backside printing B.

Figure 2:
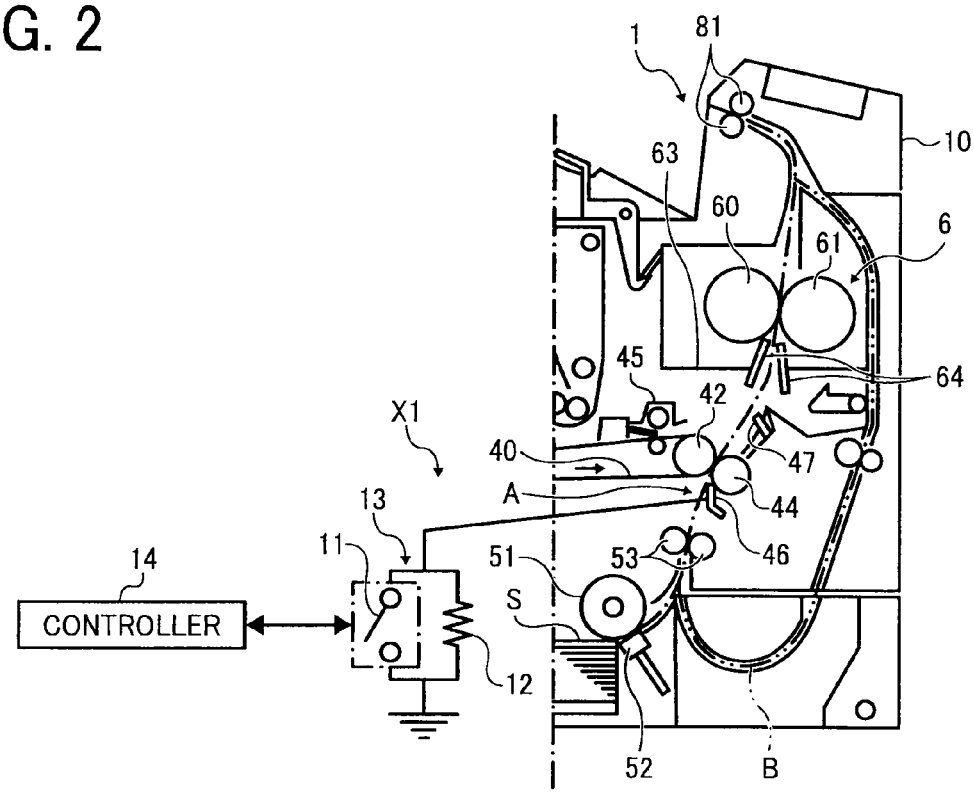
FIG. 2 is a schematic diagram for explaining a neutralizing mechanism according to a first embodiment of the present invention.

The neutralizing mechanism according to a first embodiment of the present invention is explained next. FIG. 2 is a schematic diagram for explaining a neutralizing mechanism according to the first embodiment. As an example, the neutralizing mechanism that is arranged in the pre-secondary transfer guide 46 that is "conveying path proximal member" in the printer 1 shown in FIG. 1 is explained.

As shown in FIG. 2, a neutralizing mechanism X1 according to the first embodiment is arranged in the pre-secondary transfer guide 46 that is the conveying path proximal member. The pre-secondary transfer guide 46 is connected to the ground by a conducting material such as an electric cable via a neutralizing circuit 13 in which a ground switch 11 and a resistor 12 that is a first resistor are electrically and parallely connected.

The ground switch 11, which includes (not shown) solenoid, is a solenoid switch that carries out on and off operation by the operation of the solenoid. The solenoid is connected to a controller 14 that is a controlling unit of the printer 1 and based on the control signals of the controller 14, the solenoid turns the switch on or off.

The resistor 12 is set to a predetermined electric resistance that is decided by considering transfer voltage (or transfer current), a volume resistance of the intermediate transfer belt 40, and a volume resistance of the driving roller 42 or the secondary transfer roller 44. Upon the present inventors performing the experiment by using a trial model, the predetermined resistance of more than or equal to 30 MΩ is determined as an effective value.

The operations of the neutralizing mechanism X1 are explained. At the time of applying a secondary transfer bias at least by the driving roller 42 (or the secondary transfer roller 44) that is the transfer bias applying unit, the ground switch 11 turns off. If the ground switch 11 turns off, in the neutralizing circuit 13, the ground switch 11 becomes a float switch and the transfer current flows through the resistor 12. However, because the resistor 12 is set to the high predetermined electric resistance, even if the pre-secondary transfer guide 46 contacts the sheet material S or approaches within the fixed distance (for example, five millimeters) from the sheet material S at the time of transfer, a transfer electric field can be formed without causing significant leakage of the transfer bias. When the transfer bias is not applied by the driving roller 42, the ground switch 11 turns on. If the ground switch 11 turns on, in the neutralizing circuit 13, because resistance is nearly eliminated on the ground switch 11 side, the static electricity accumulated on the pre-secondary transfer guide 46 due to friction with the sheet material S, can be transferred to the ground side and the biased potential can be corrected.

The secondary transfer bias can be applied at the time of passing the sheet (for example, until rotation of the fixing roller 60 or the pressure roller 61 starts after rotation of the registration roller pair 53 is started).

In the neutralizing mechanism X1, leakage of the transfer voltage can be prevented due to the resistance of the resistor 12. Due to this, as compared to a material such as resin that is used in the existing image forming apparatus, a material of a low electric resistance can be used for the pre-secondary transfer guide 46. Thus, as compared to the existing image forming apparatus, a minimum resistance from the pre-secondary transfer guide 46 until ground connection of the pre-secondary transfer guide 46 is reduced and neutralization of the pre-secondary transfer guide 46 can be rapidly carried out in a short time. A metal product, for example, a metal stamped product can be used as the material for the pre-secondary transfer guide 46. If the metal stamped product is used, extremely precise fixing angles and dimensions can be used. The metal stamped product has an excellent abrasion resistance and also includes a low cost.

If the pre-secondary transfer guide 46 is formed of a resin of a comparatively high resistance, the charge is obstructed due to resistance, thus causing a delay in transferring the charge to the ground. In other words, time required for the neutralization increases. Thus, when the secondary transfer bias is not applied, connecting the ground switch 11 by constantly keeping the ground switch 11 switched on is effective. The ground switch 11 can be turned on at a suitable time when the secondary transfer bias is not applied, for example, during activation warm-up time of the printer 1 and after passing a predetermined number of sheets, during a predetermined time and the static electricity can be removed by earthing the static electricity that is accumulated on the pre-secondary transfer guide 46. Controlling the ground switch 11 as the solenoid switch by the controller 14 is explained. However, instead of controlling by an electronic device such as the controller 14, the ground switch 11 can be turned on by connecting the ground switch 11 to the device body 10 when a cover of the device body 10 is opened. Furthermore, a separate neutralizing switch can be arranged in an operation panel of the printer 1 and the ground switch 11 can be turned on when a user presses the separate neutralizing switch.

As described above, in the first embodiment of the present invention, the neutralizing mechanism X1 that is arranged in the pre-secondary transfer guide 46 is explained. However, apart from the pre-secondary transfer guide 46, the neutralizing mechanism X1 can be arranged in another conveying path proximal member. When the neutralizing mechanism X1 is arranged in the other conveying path proximal member, without causing leakage of the transfer bias, the static electricity on the conveying path proximal member can be removed.

For example, if the neutralizing mechanism X1 is arranged in "neutralizing needles 47" instead of arranging in "pre-secondary transfer guide 46", image degradation due to discharging between the peripheral members of the conveying path A from the neutralizing needles 47 onwards and the sheet material S can be prevented in the conveying direction and discharging from the neutralizing needles 47 to the sheet material S can also be prevented by charging the neutralizing needles 47 by friction with air or the sheet material S. Generally, if the neutralizing needles 47 are charged to more than or equal to one kilovolts (kV), discharging is more likely to occur.

"Fixing frame 63" and "pre-fixing guide 64" are placed in an environment dried due to high temperature, thus including less moisture contents. In other words, because the electric resistance of the fixing frame 63 and the pre-fixing guide 64 is comparatively high, a likelihood of charging increases. By considering the above, if the neutralizing mechanism X1 is arranged in the fixing frame 63 or the pre-fixing guide 64, the neutralization can be carried out without causing leakage of the transfer bias from the fixing frame 63 or the pre-fixing guide 64 via the sheet material S. Thus, arranging the neutralizing mechanism X1 in the fixing frame 63 or the prefixing guide 64 is extremely useful.

If "registration roller pair 53" is charged in the vicinity of the feed tray 50 that houses and stocks the sheet materials S such as copy sheets, due to electrostatic attractive force, dust such as paper dust of the sheet material S easily adheres to "registration roller pair 53". Thus, if the neutralizing mechanism X1 is arranged in the registration roller pair 53, adhesion of dust can be prevented. To be specific, in a recycle paper and a poor quality paper, impurities other than pulpwood are highly included. Thus, by arranging the neutralizing mechanism X1 in the registration roller pair 53, adhesion of the impurities to the registration roller pair 53 can be prevented. If a thin sheet is conveyed as the sheet material S and the registration roller pair 53 cannot be neutralized, drawbacks that are explained below are likely to occur. The thin sheet sticks to the registration roller pair 53 and cannot be properly inserted into the secondary transfer nip. Depending on the situations, the thin sheet is likely to wrap around the secondary transfer roller 44. However, by arranging the neutralizing mechanism in the registration roller pair 53, the drawbacks mentioned earlier can be overcome.

Because the sheet material S conveyed in the conveying path B that is "conveying path for backside printing" once passes through the fixing unit 6, the moisture evaporates due to heat, thus reducing the moisture contents included in the sheet material S. Due to this, the conveying path B is easily charged due to friction with the sheet material S of low dampness. If the sheet material S passes inside the charged conveying path B, the (backside) image that is to be transferred onto the sheet material S is likely to be deteriorated. The sheet material S that has reached the secondary transfer nip again via the conveying path B is subjected to secondary transfer bias application such that a rear end of the sheet material S in the conveying direction is still in the conveying path B due to the size of the sheet material S. Thus, by arranging the neutralizing mechanism X1 according to the present embodiment, the neutralization can be more effectively carried out without causing leakage of the transfer bias.

Figure 3:
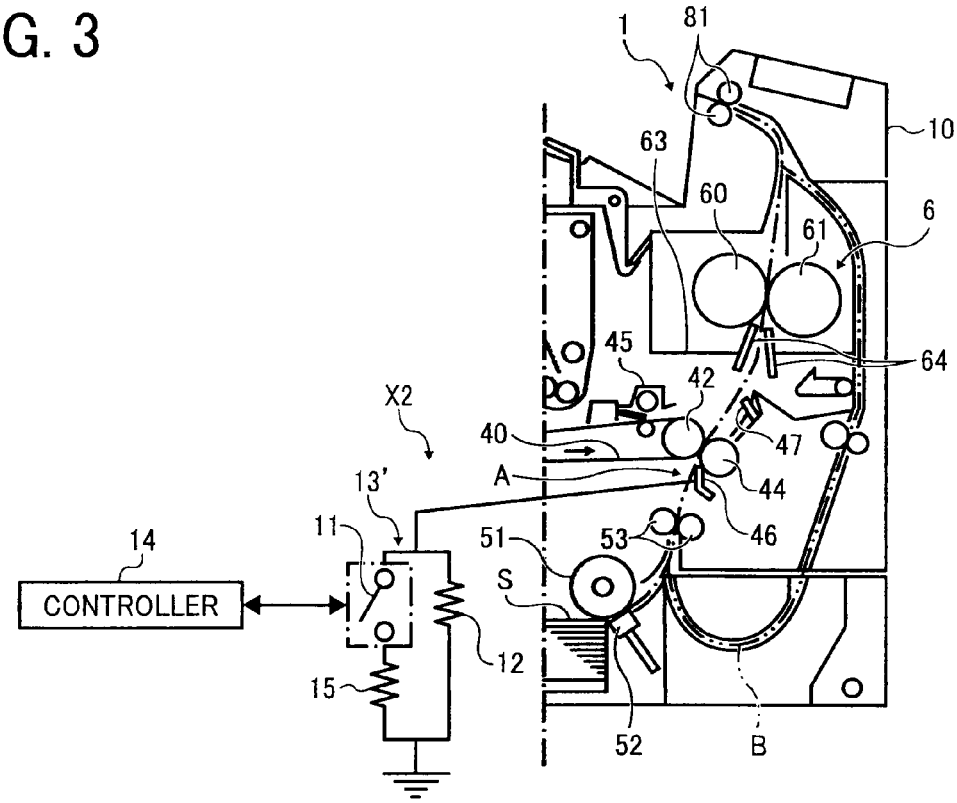
FIG. 3 is a schematic diagram for explaining a neutralizing mechanism according to a second embodiment of the present invention.

A neutralizing mechanism according to a second embodiment of the present invention is explained next. FIG. 3 is a schematic diagram for explaining the neutralizing mechanism according to the second embodiment. Compared to the neutralizing mechanism shown in FIG. 2, in the neutralizing mechanism according to the second embodiment, one more resistor is added to the neutralizing circuit 13 according to the first embodiment. Thus, the neutralizing mechanism is explained by using the same reference numerals. As shown in FIG. 3, similarly as the neutralizing mechanism X1 according to the first embodiment, a neutralizing mechanism X2 according to the second embodiment is arranged in the pre-secondary transfer guide 46 that is the conveying path proximal member. The pre-secondary transfer guide 46 is connected to the ground by the conducting material such as the electric cable via a neutralizing circuit 13'. Similarly as the neutralizing circuit 13 according to the first embodiment, in the neutralizing circuit 13', the ground switch 11 and the resistor 12 that is the first resistor are electrically and parallely connected. Furthermore, a resistor 15, which is a second resistor, is connected to the ground switch 11 in a series and parallel to the resistor 12. A predetermined resistance of the resistor 15 is set such that the resistance of the resistor 15 is lower than the resistance of the resistor 12. Generally, time of charge reduction of the pre-secondary transfer guide 46 is proportionate to the resistance of a resistor. Thus, it is desirable to sufficiently decrease the resistance of the resistor 15 than the resistance of the resistor 12. For example, if the resistance of the resistor 15 is one-tenth the resistance of the resistor 12, the time of charge reduction of the pre-secondary transfer guide 46 is also reduced by one-tenth and is effective.

Operations of the neutralizing mechanism X2 are explained below. Similarly as in the first embodiment, at the time of applying the secondary transfer bias at least by the driving roller 42 (or the secondary transfer roller 44) of the printer 1, the ground switch 11 turns off. If the ground switch 11 turns off, in the neutralizing circuit 13', the transfer current flows through the resistor 12. However, because the resistor 12 includes the high predetermined electric resistance, even if the pre-secondary transfer guide 46 contacts the sheet material S at the time of transfer or approximates within the fixed distance from the sheet material S, the transfer electric field can be formed without causing significant leakage of the transfer bias. When the secondary transfer bias is not applied by the driving roller 42, the ground switch 11 turns on. If the ground switch 11 turns on, because the resistance of the resistor 15 is smaller than the resistance of the resistor 12, the static electricity accumulated on the pre-secondary transfer guide 46 (conveying path proximal member) passes through the side of the neutralizing circuit 13' where the ground switch 11 and the resistor 15 are connected in a series, and the static electricity is then transferred to the ground. In other words, the difference when compared with the neutralizing mechanism X1 is that in the neutralizing mechanism X2, even though the ground switch 11 turns on, the charge cannot be transferred to the ground unless the charge passes through the resistor 15. Thus, when the ground switch 11 turns on, the charge is not abruptly transferred (abrupt flow of high current). Due to this, the peripheral members of the neutralizing mechanism (or conveying path proximal member) are not likely to damage. To be specific, when the peripheral members include electronic components, because the peripheral members are affected and likely to be damaged, thus becoming unusable, arranging the neutralizing mechanism X2 according to the present embodiment is effective.

Figure 4:
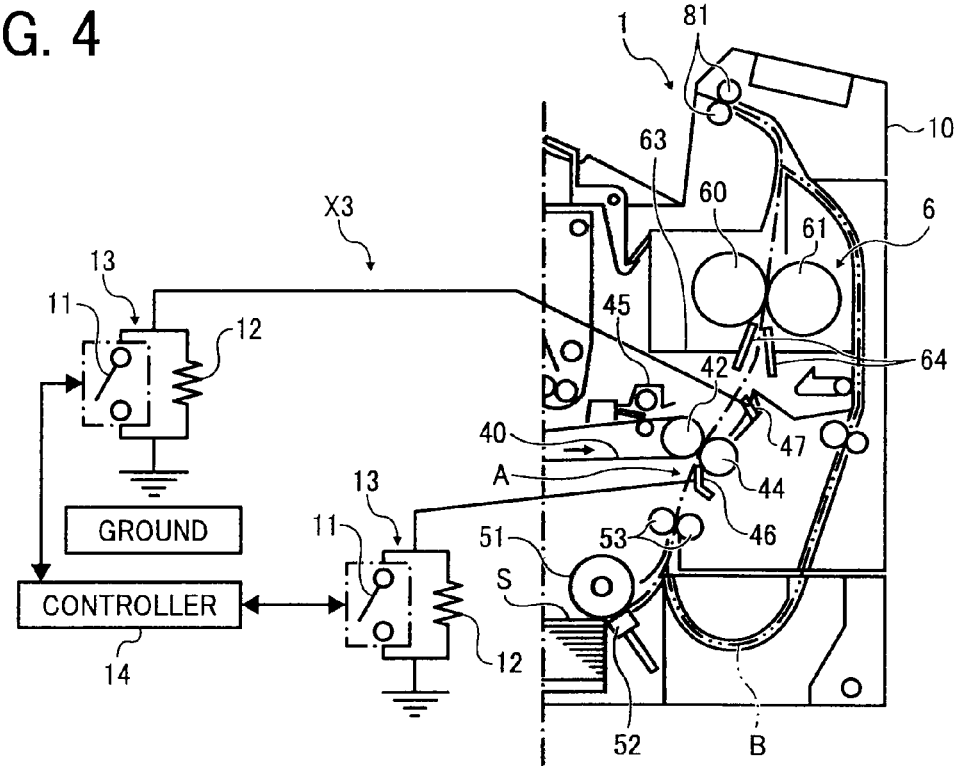
FIG. 4 is a schematic diagram for explaining a neutralizing mechanism according to a third embodiment of the present invention.

A neutralizing mechanism according to a third embodiment of the present invention is explained next. FIG. 4 is a schematic diagram for explaining the neutralizing mechanism according to the third embodiment. In the first embodiment, the neutralizing mechanism X1 that is shown in FIG. 2 is arranged only in the pre-secondary transfer guide 46. However, in the third embodiment, the neutralizing mechanism is arranged in the pre-secondary transfer guide 46 and also in the neutralizing needles 47. Thus, the structure similar to the structure mentioned in the first embodiment is explained by using the same reference numerals. As shown in FIG. 4, a neutralizing mechanism X3 according to the third embodiment, which includes two neutralizing circuits 13 having the same structure as the structure of the neutralizing circuit 13 according to the first embodiment, is arranged between the pre-secondary transfer guide 46 and the ground and is also arranged between the neutralizing needles 47 and the ground. The pre-secondary transfer guide 46 and the neutralizing needles 47 are respectively connected to the ground by the conducting material such as the electric cable via the neutralizing circuits 13.

Operations of the neutralizing mechanism X3 are similar to the operations of the neutralizing mechanism X1 according to the first embodiment, thus omitting the explanation.

Thus, by respectively arranging a separate neutralizing mechanism in the pre-secondary transfer guide 46 and the neutralizing needles 47, the pre-secondary transfer guide 46 and the neutralizing needles 47 can be simultaneously neutralized. Usually, image degradation that occurs by charging the pre-secondary transfer guide 46 and the neutralizing needles 47 can be prevented and at the time of applying the transfer bias, the transfer bias does not leak. Arranging the neutralizing mechanism in the pre-secondary transfer guide 46 and the neutralizing needles 47 is explained as an example. However, the neutralizing mechanism is not limited to the pre-secondary transfer guide 46 and the neutralizing needles 47. Among "conveying path proximal members", the neutralizing mechanism can be arranged in any conveying path proximal member. Instead of arranging in two conveying path proximal members, the neutralizing mechanism can be arranged in multiple conveying path proximal members.

From a plurality of arranged neutralizing circuits, the neutralizing circuit 13 is explained as an example. The neutralizing circuit 13 can be replaced by the neutralizing circuit 13' according to the second embodiment. Furthermore, the neutralizing circuit 13 and the neutralizing circuit 13' can be combined. Whether to use the neutralizing circuit 13 or the neutralizing circuit 13' can be selected by considering the volume resistance of the conveying path proximal member in which the neutralizing mechanism is arranged. For example, if the pre-secondary transfer guide 46 is formed of the metal product of a small volume resistance, the neutralizing circuit 13' can be selected. Even if the ground switch 11 is turned on, the neutralization cannot be carried out unless the charge passes through the resistor 15. Thus, as mentioned earlier, the high current does not flow abruptly. Consequently, damaging of the peripheral members such as the electronic components of the neutralizing mechanism can be prevented. Furthermore, if the fixing frame 63 is formed of the resin of the comparatively large resistance, by selecting the neutralizing circuit 13, the fixing frame 63 can be rapidly neutralized. In other words, the neutralizing circuit can be selected such that the minimum resistance from the conveying path proximal member until the ground is within a predetermined range.

If the volume resistance of the conveying path proximal member in which the neutralizing mechanism is arranged is small, the vicinity of the conveying path proximal member includes places that generate large current and high voltage, and a charge amount of the conveying path proximal member is large, the large current is more likely to flow when the ground switch 11 turns off. Thus, earthing needs to be carried out exclusively via the resistor 15 by selecting the neutralizing circuit 13'.

Figure 5:
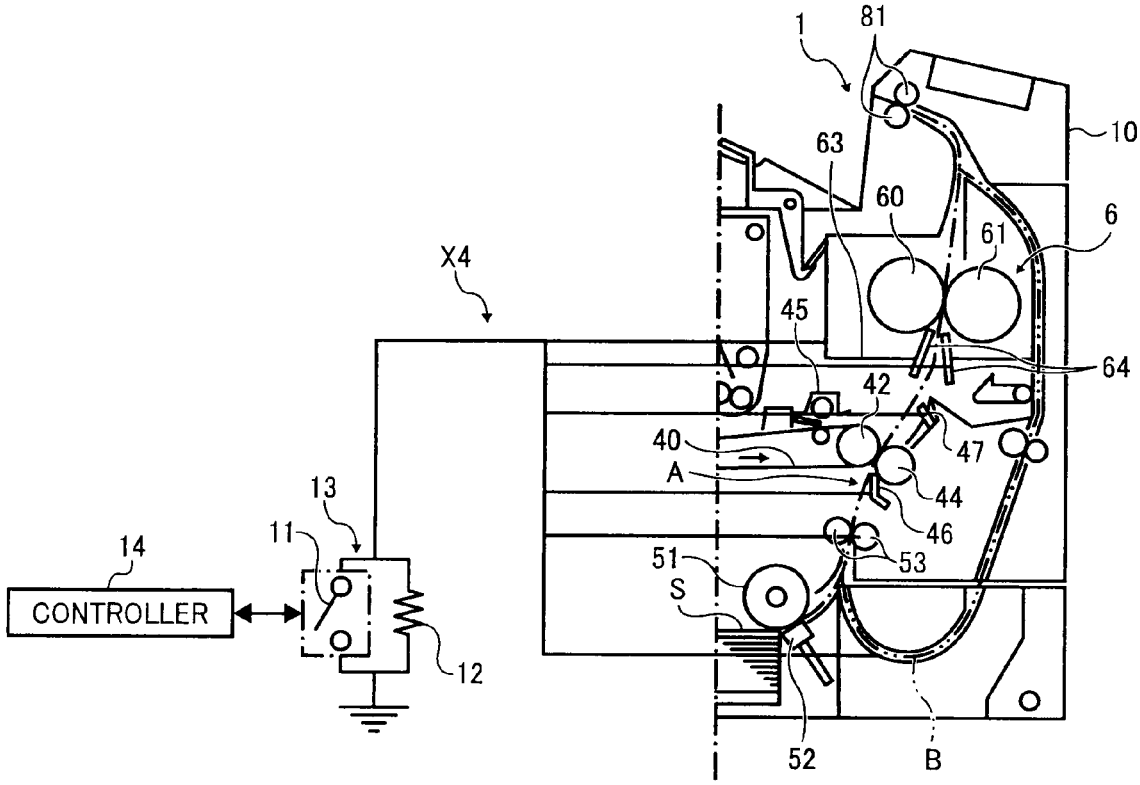
FIG. 5 is a schematic diagram for explaining a neutralizing mechanism according to a fourth embodiment of the present invention.

A neutralizing mechanism according to a fourth embodiment of the present invention is explained next. FIG. 5 is a schematic diagram for explaining the neutralizing mechanism according to the fourth embodiment. In the fourth embodiment, compared to the neutralizing mechanism shown in FIG. 2, in the neutralizing mechanism according to fourth embodiment, a plurality of conveying path proximal members are connected to the neutralizing circuit 13 according to the first embodiment. The structure similar to the structure mentioned in the first embodiment is explained by using the same reference numerals. As shown in FIG. 5, in a neutralizing mechanism X4 according to the fourth embodiment, the conveying path proximal members are connected to the single neutralizing circuit 13 and the conveying path proximal members are connected to the ground by the conducting material such as the electric cable via the neutralizing circuit 13. In FIG. 5, the conveying path proximal members in which the neutralizing mechanism X4 is arranged are the registration roller pair 53, the pre-secondary transfer guide 46, the neutralizing needles 47, the pre-fixing guide 64, the fixing frame 63, and the conveying path B. Operations of the neutralizing mechanism X4 are similar to the operations of the neutralizing mechanism X1 according to the first embodiment, thus omitting the explanation.

Although a plurality of neutralizing circuits are not arranged, image degradation that occurs by charging the conveying path proximal members without causing leakage of the transfer bias can be prevented.

The neutralizing circuit 13 is explained as the example. However, the neutralizing circuit 13 can be replaced by the neutralizing circuit 13' according to the second embodiment. Instead of connecting the conveying path proximal members to the single neutralizing circuit, the conveying path proximal members can be connected to the neutralizing circuits. Thus, based on the size of the volume resistance of the conveying path proximal member and based on whether the large current and high voltage generating places exist in the vicinity of the conveying path proximal member, the neutralizing circuit can be divided into the neutralizing circuit 13 and the neutralizing circuit 13' such that the minimum resistance from the conveying path proximal members until the ground is within the predetermined range.

The neutralizing mechanism according to the embodiments of the present invention is explained. However, depending upon a usage environment such as arrangement location and season, the electric resistance of the sheet material and each member of the image forming apparatus significantly differs. To be specific, when the temperature is hot and humid, moisture contents in the sheet material are high. Thus, charging the sheet material becomes difficult and leakage of the transfer bias through the sheet material becomes easy. However, when the temperature is low and humidity is low, the moisture contents in the sheet material are extremely less. Thus, charging the sheet material becomes easy and leakage of the transfer bias through the sheet material becomes difficult.

However, the neutralizing mechanism in the existing image forming apparatus is only compatible with either high temperature and high humidity or low temperature and low humidity. The neutralizing mechanism in the existing image forming apparatus is a complex and space occupying mechanism, thus resulting in high cost. However, in the neutralizing mechanism according to the embodiments of the present invention, instead of changing to a high resistance, the electric resistance of the conveying path proximal member in which the resistance changes according to the usage environment, the minimum resistance necessary for preventing leakage of the transfer bias can be secured simply by setting the resistance of the resistor 12 and the resistor 15 to a suitable value. Thus, leakage of the transfer bias can be reliably prevented by using the neutralizing mechanism that is simple, compact, low cost, and that does not depend on the usage environment. Furthermore, if the neutralizing mechanism is arranged in a plurality of members that are the conveying path proximal members, even if at the time of applying the transfer bias, the sheet material contacts two members that are the conveying path proximal members or the sheet material S is within the fixed distance, the conveying path proximal member can discharge the sheet material that contacts the conveying path proximal member. Thus, leakage of the transfer current, due to the high temperature and high humidity, to the conveying path proximal members via the sheet material S having low electric resistance can be prevented. Furthermore, the static electricity that spoils the unfixed image can be removed from the sheet material or the peripheral members. In other words, without depending on the usage environment, image quality of the transfer image can be secured.

As the example of the image forming apparatus according to the embodiments of the present invention, the four-color tandem-type printer including the direct transfer method is explained. However, the present invention is not to be thus limited. The printer including the indirect transfer method can also be used. In other words, the image forming apparatus that includes the transfer device of the direct or the indirect method that transfers the image onto the sheet material from the image carrying member by applying the transfer bias can be used.

The laser scanning unit, the image forming unit, the primary transfer unit, the sheet feeding unit, the fixing unit, the waste-toner storage unit, the sheet loading unit are merely examples. By using other commonly known devices and units, similar effects can be achieved to overcome the drawbacks that occur in the other devices and units.

The constituent elements of the device shown in the drawings are merely an example.

According to one aspect of the present invention, by using a low cost and a simple circuit structure including a switch and a resistor, a conveying path proximal member can be neutralized without causing a leakage of a transfer bias. Thus, by charging the conveying path proximal member, degradation of image quality such as toner scattering and raggedness of a transfer image can be prevented.

Furthermore, according to another aspect of the present invention, at the time of neutralizing the conveying path proximal member, the neutralization can be carried out without resulting in abrupt charge transfer. Thus, damaging of the conveying path proximal member, a neutralizing mechanism, and peripheral members of the neutralizing mechanism and spoiling of an unfixed transfer image due to flow of large current can be prevented.

Moreover, according to still another aspect of the present invention, even if the neutralizing mechanism does not include single neutralizing circuit for respective conveying path proximal member, the effects mentioned earlier can be achieved by neutralizing the conveying path proximal members, thus reducing a cost of an entire device.

Furthermore, according to still another aspect of the present invention, a low cost ground switch that is automatically controllable by a controller (controlling unit) of an image forming apparatus can be formed.

Moreover, according to still another aspect of the present invention, a sheet material after transfer can be neutralized by neutralizing needles and by using the simple and the low cost circuit structure including the switch and the resistor, static electricity accumulated on the neutralizing needles can be earthed and removed without causing leakage of the transfer bias from the neutralizing needles. Thus, degradation of the image quality of the transfer image can be prevented.

Furthermore, according to still another aspect of the present invention, the effects mentioned earlier can be achieved as the image forming apparatus.

Moreover, according to still another aspect of the present invention, only by adding the simple and the low cost neutralizing circuit including the switch and the resistor, the conveying path proximal member arranged opposite conveying paths in the vicinity of a secondary transfer position can be neutralized without causing leakage of a secondary transfer bias. Thus, by charging the conveying path proximal member, degradation of image quality such as toner scattering and raggedness of the transfer image can be prevented.

Furthermore, according to still another aspect of the present invention, the sheet material can be smoothly guided to the secondary transfer position by a pre-secondary transfer guide. Furthermore, by adding the simple and the low cost circuit structure including the switch and the resistor, the pre-secondary transfer guide where the static electricity is easily accumulated due to friction with the sheet material can be neutralized without causing leakage of the secondary transfer bias. Thus, by charging the pre-secondary transfer guide, degradation of image quality such as toner scattering and raggedness of the transfer image can be prevented.

Moreover, according to still another aspect of the present invention, by neutralizing the sheet material by using the neutralizing needles, the sheet material can be easily separated from an intermediate transfer belt. Furthermore, by adding the simple and the low cost circuit structure including the switch and the resistor, the static electricity accumulated on the neutralizing needles can be neutralized without causing leakage of the secondary transfer bias. Thus, by charging the neutralizing needles, degradation of image quality such as toner scattering and raggedness of the transfer image can be prevented.

Furthermore, according to still another aspect of the present invention, heat generated by a fixing unit in a fixing frame is insulated and adverse effects resulting from heat at the time of image forming or at the time of transfer can be prevented. Furthermore, by adding the simple and the low cost circuit structure including the switch and the resistor, the fixing frame can be neutralized without causing leakage of the secondary transfer bias. Thus, by charging the fixing frame, degradation of image quality such as toner scattering and raggedness of the transfer image can be prevented.

Moreover, according to still another aspect of the present invention, the sheet material can be smoothly guided to the fixing unit by a pre-fixing guide. Furthermore, by adding the simple and the low cost circuit structure including the switch and the resistor, the pre-fixing guide can be neutralized without causing leakage of the secondary transfer bias. Thus, by charging the pre-fixing guide, degradation of image quality such as toner scattering and raggedness of the transfer image can be prevented.

Furthermore, according to still another aspect of the present invention, the controller exercises control such that sheet feeding timing can be adjusted by registration rollers and the sheet material can be supplied to a secondary transfer device. Furthermore, by adding the simple and the low cost circuit structure including the switch and the resistor, the registration rollers can be neutralized without causing leakage of the secondary transfer bias. Thus, by charging the registration rollers, degradation of image quality such as toner scattering and raggedness of the transfer image can be prevented.

Moreover, according to still another aspect of the present invention, duplex printing can be carried out by reversing the sheet material by using a conveying path for backside printing. Furthermore, by adding the simple and the low cost circuit structure including the switch and the resistor, the conveying path for backside printing can be neutralized without causing leakage of the secondary transfer bias. Thus, by charging the conveying path for backside printing, degradation of image quality such as toner scattering and raggedness of the transfer image can be prevented.

Furthermore, according to still another aspect of the present invention, even if the neutralizing mechanism that includes single neutralizing circuit for respective conveying path proximal member is not arranged, the effects mentioned earlier can be achieved by neutralizing the conveying path proximal members, thus reducing the cost of the entire device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device that transfers an image from an image carrying member onto a sheet material by applying a transfer bias, the transfer device comprising:

a neutralizing mechanism that is provided in at least one conveying path proximal member from among a plurality of conveying path proximal members that is installed on conveying paths of the sheet material in a vicinity of a transfer position, makes contact with the sheet material at a time of applying the transfer bias or is placed within a range of a fixed distance from the sheet material, and is grounded by using a conducting material, wherein the neutralizing mechanism includes a neutralizing circuit that includes a first resistor having a first resistance and a ground switch electrically connected in parallel to each other, and the ground switch is turned off at least at a time of applying the transfer bias to prevent a leakage of a transfer current, and turned on for a predetermined time at a time other than the time of applying the transfer bias to earth and remove a static electricity accumulated on the conveying path proximal member.

2. The transfer device according to claim 1, wherein the neutralizing circuit further includes a second resistor having a second resistance lower than the first resistance, and the second resistor is connected to the ground switch in series and to the first resistor in parallel.

3. The transfer device according to claim 1, wherein the neutralizing mechanism is provided in a plurality of conveying path proximal members, and the neutralizing circuit is connected to each of the conveying path proximal members using a conducting material.

4. The transfer device according to claim 1, wherein the ground switch that is a solenoid switch that turns on and off by an operation of a solenoid.

5. The transfer device according to claim 1, wherein the conveying path proximal member in which the neutralizing mechanism is provided is a neutralizing needle that neutralizes the sheet material after transferring the image.

6. An image forming apparatus comprising:

a transfer device that transfers an image from an image carrying member onto a sheet material by applying a transfer bias, the transfer device including a neutralizing mechanism that is provided in at least one conveying path proximal member from among a plurality of conveying path proximal members that is installed on conveying paths of the sheet material in a vicinity of a transfer position, makes contact with the sheet material or is placed within a range of a fixed distance from the sheet material, and is grounded by using a conducting material, wherein the neutralizing mechanism includes a neutralizing circuit that includes a first resistor having a first resistance and a ground switch electrically connected in parallel to each other, and the ground switch is turned off at least at a time of applying the transfer bias to prevent a leakage of a transfer current, and turned on for a predetermined time at a time other than the time of applying the transfer bias to earth and remove a static electricity accumulated on the conveying path proximal member.

7. An image forming apparatus comprising:

a transfer device that directly transfers an image from an intermediate transfer belt onto a sheet material; and a neutralizing mechanism that is provided in at least one conveying path proximal member from among a plurality of conveying path proximal members that is installed on conveying paths of the sheet material in a vicinity of a secondary transfer position, makes contact with the sheet material at a time of applying a secondary transfer bias or is placed within a range of a fixed distance from the sheet material, and is grounded by using a conducting material, wherein the neutralizing mechanism includes a neutralizing circuit that includes a first resistor having a first resistance and a ground switch electrically connected in parallel to each other, and the ground switch is turned off at least at a time of applying the secondary transfer bias to prevent a leakage of a transfer current, and turned on for a predetermined time at a time other than the time of applying the secondary transfer bias to earth and remove a static electricity accumulated on the conveying path proximal member.

8. The image forming apparatus according to claim 7, wherein the conveying path proximal member in which the neutralizing mechanism is provided is a pre-secondary transfer guide that guides the sheet material to a secondary transfer device.

9. The image forming apparatus according to claim 7, wherein the conveying path proximal member in which the neutralizing mechanism is provided is a neutralizing needle that neutralizes the sheet material after a secondary transfer.

10. The image forming apparatus according to claim 7, wherein the conveying path proximal member in which the neutralizing mechanism is provided is a fixing frame that covers and separates a fixing device.

11. The image forming apparatus according to claim 7, wherein the conveying path proximal member in which the neutralizing mechanism is provided is a pre-fixing guide that guides the sheet material to a fixing device.

12. The image forming apparatus according to claim 7, wherein the conveying path proximal member in which the neutralizing mechanism is provided is a registration roller that adjusts a timing in synchronization with transfer and supplies the sheet material to a secondary transfer device.

13. The image forming apparatus according to claim 7, wherein the conveying path proximal member in which the neutralizing mechanism is provided is a conveying path for backside printing that reverses the sheet material for a duplex printing.

14. The image forming apparatus according to claim 7, wherein the neutralizing mechanism is provided in a plurality of conveying path proximal members, and the neutralizing circuit is connected to each of the conveying path proximal members using a conducting material.

* * * * *